United States Patent [19]

Di Stefano

[11] 4,213,427

[45] Jul. 22, 1980

[54] ROTARY ENGINE

[76] Inventor: Alfonso Di Stefano, 1413 Wayburn, Grosse Pointe Park, Mich. 48236

[21] Appl. No.: 915,982

[22] Filed: Jun. 16, 1978

Related U.S. Application Data

[63] Continuation of Ser. No. 757,826, Jan. 10, 1977, abandoned, which is a continuation-in-part of Ser. No. 617,696, Sep. 29, 1975, abandoned.

[51] Int. Cl.[2] ..... F02B 57/00

[52] U.S. Cl. ..... 123/43 AA; 277/136

[58] Field of Search ..... 123/43 A, 43 AA; 277/136, 137, 199, 214

[56] References Cited

U.S. PATENT DOCUMENTS

| | | | |
|---|---|---|---|
| 732,837 | 7/1903 | Dobson | 277/136 |
| 928,715 | 7/1909 | Thurber | 123/43 A |
| 1,397,334 | 11/1921 | Schmolinsky | 277/214 |
| 1,569,525 | 1/1926 | Owens | 123/43 AA |
| 1,604,474 | 10/1926 | Nisbet | 123/43 AA |
| 1,628,100 | 5/1927 | Bacon | 123/43 AA |
| 2,276,772 | 3/1942 | Heap | 123/43 AA |
| 3,068,709 | 12/1962 | Petersen | 123/43 AA |
| 3,587,538 | 6/1971 | Poole | 123/43 A |
| 3,598,094 | 8/1971 | Odawara | 123/43 A |
| 3,899,880 | 8/1975 | Rohs | 123/43 A |

FOREIGN PATENT DOCUMENTS

| | | | |
|---|---|---|---|
| 17848 | 1/1930 | Australia | 277/136 |
| 879624 | 6/1953 | Fed. Rep. of Germany | 123/58 AM |
| 479939 | 2/1916 | France | 123/43 A |
| 18241 | of 1912 | United Kingdom | 123/43 A |

*Primary Examiner*—Michael Koczo
*Attorney, Agent, or Firm*—Joseph W. Farley

[57] ABSTRACT

A four-cycle rotary engine having a generally tubular cylindrical housing with end covers rotatably supporting an output shaft extending axially of the housing, an annular cylinder block assembly, secured to and surrounding the output shaft, has a plurality of cylinders extending axially parallel to the output shaft and a piston mounted in each cylinder. Each piston has a rod constrained to move parallel to the axis of the output shaft by guides formed on the cylinder block, and each rod has roller followers engaging opposed cam tracks of a stationary drive ring secured to the housing. The cam tracks are sinusoidal, are circularly concentric with the axis of the drive shaft, define the working strokes of the cylinders, and cause the cylinder assembly and the output shaft to rotate from the reaction between each rod and the cam tracks on the combustion stroke of each piston. Intake and exhaust ports in the head and cover of the housing automatically admit the fuel-air mixture and release the exhaust gases as the cylinder rotates.

17 Claims, 20 Drawing Figures

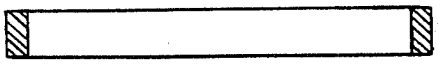
FIG. 8
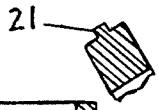
FIG. 7
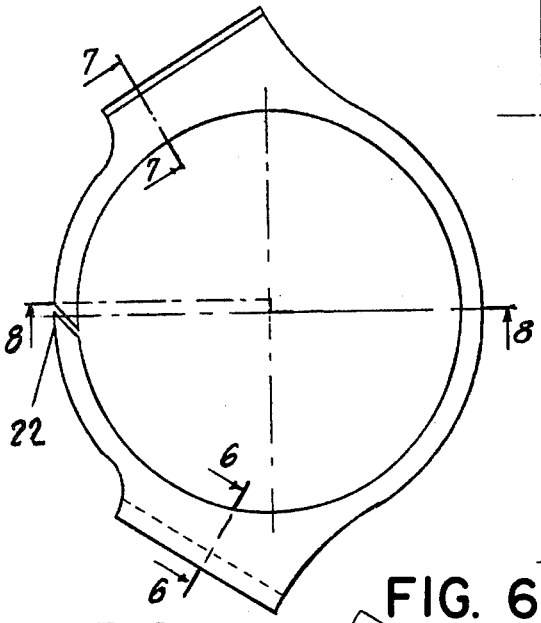
FIG. 5
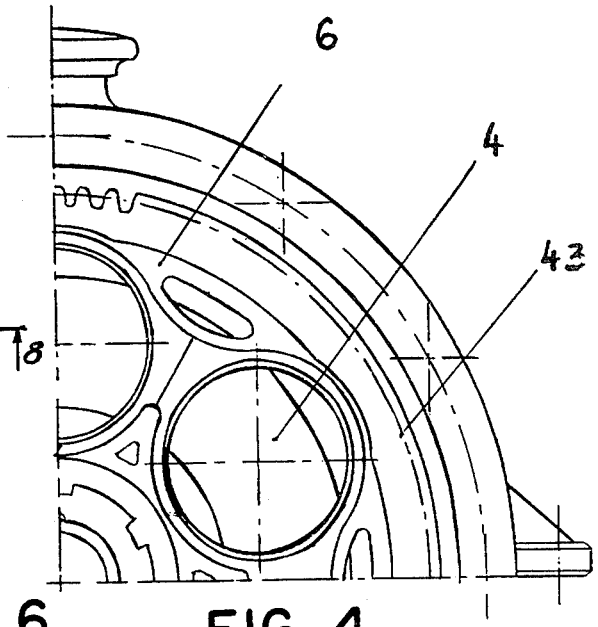
FIG. 4
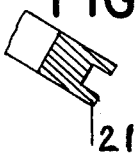
FIG. 6
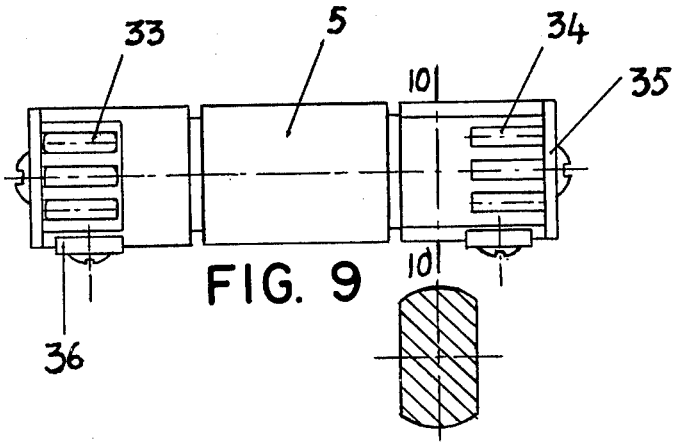
FIG. 9
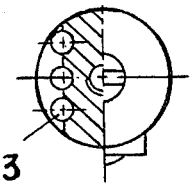
FIG. 11
FIG. 10

FIG.18
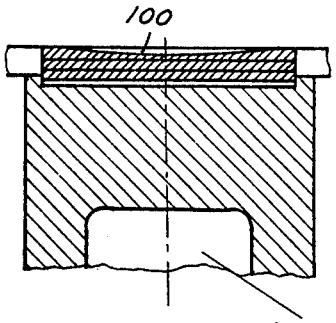
FIG.17
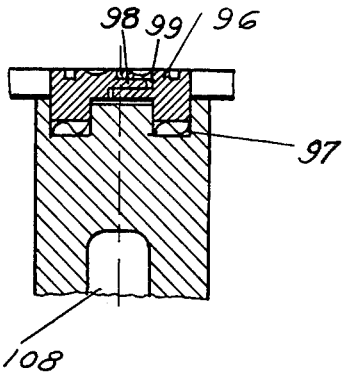
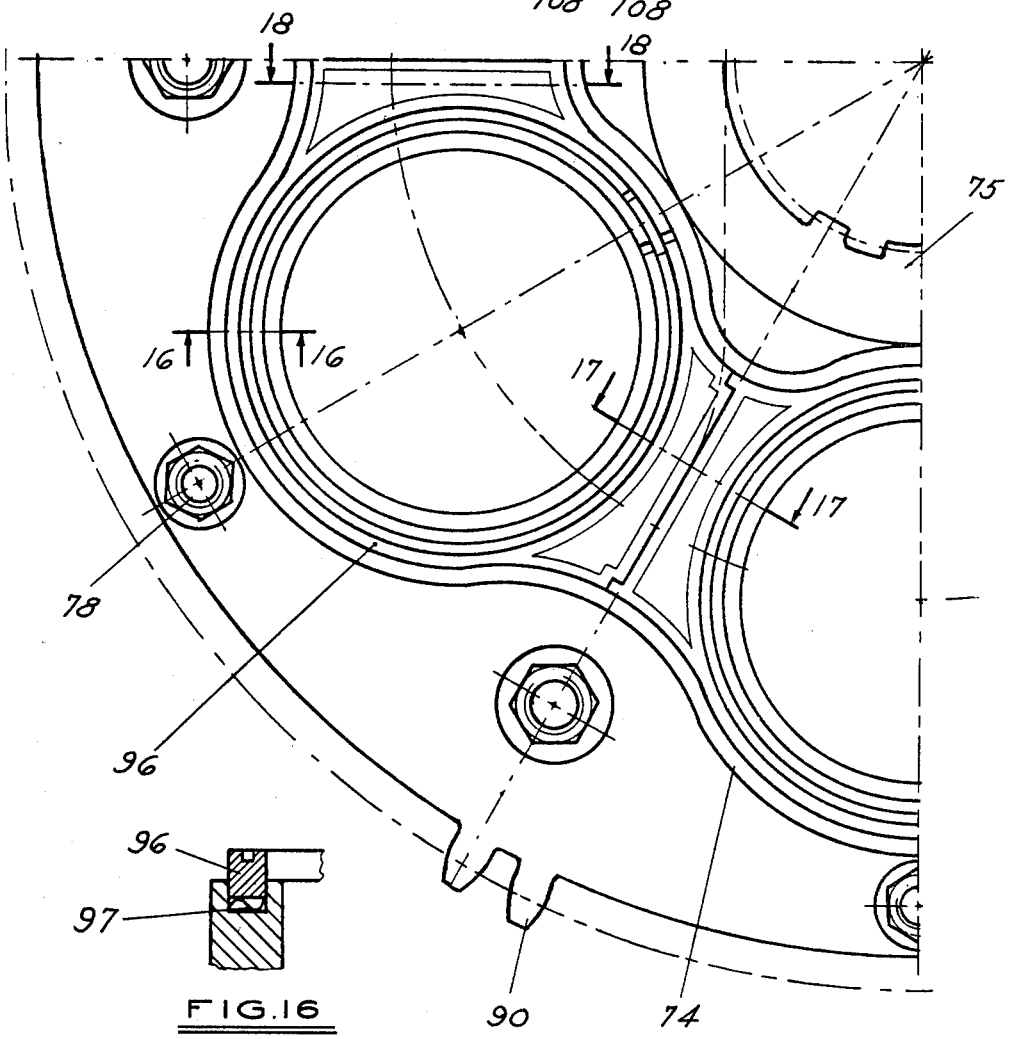
FIG.16
FIG.15

ROTARY ENGINE

This application is a continuation of application Ser. No. 757,826, filed Jan. 10, 1977 (now abandoned), which was a continuation-in-part of application Ser. No. 617,696, filed Sept. 29, 1975 and now abandoned.

This invention relates to improvements in engines having a rotating cylinder block in which the axis of each cylinder extends parallel to the axis of block rotation.

At the present moment, the development of the technical aspects of the internal combustion Otto or Diesel cycle engines is undergoing a period of stagnancy, essentially due to the discrete efficiency and reliability of the traditional propulsion units being used, which, aided by their particular good attributes, have not inspired any research to develop other innovative alternatives that have not been either the remodeling of details on the traditional engines or the use of new construction materials. In the area of transforming the displaced motion of the piston into a rotary motion of the shaft, the trend has been closely tied to the ordinary crank shaft system which uses pistons, connecting rods, and a crank shaft.

The consequential problems of such a system are essentially caused by the inertia of the connecting rods, the adequate balancing of the crank shaft, along with the relative arrangement of their supports, and finally, by the arrangement of the valves and camshaft.

The present invention provides a different solution for developing rotary motion—obtained up to now from a fixed section, that of the cylinders, and a moveable section, the crank shaft—by transferring the motion of a cylinder-enclosed piston from its top dead center and its bottom dead center to the surface of a stationary guide rail.

In the explosion cycle, the force exerted downwards on the piston results in a component which, transmitted to the cylinder at an opportune moment, makes the latter displace itself, in order that the piston permanently remains vertical and centered. By making the stationary rail as a circular surface with sufficient "peaks" and "valleys" to allow the four phases of a complete cycle to take place, and by connecting all the cylinders to a central shaft, the displacing motion of the pistons is transformed into a rotary one of the motor shaft. The block assumes the appearance of a revolving gun barrel with axial holes where the cylinders are lodged. The cylinder chambers are closed on one end by a head cover which contains the intake, ignition, and exhaust mechanisms; the other end is sealed by a cover supporting the guide rail for defining the piston strokes.

The annexed drawings refer to the above-mentioned type of engine which has the following specifications:

CYLINDERS 6
CYCLE: Otto
BORE: 50 mm
STROKE: 77 mm
COMPRESSION RATIO: 9:1

DESCRIPTION OF THE DRAWINGS

FIG. 4 is an enlarged sectional elevation showing a quarter view of the head end of the engine with the head cover removed;

FIG. 5 is an enlarged plan view of a seal employed at the head end of each cylinder between the block and the cylinder head;

FIG. 6 is a sectional detail taken on the line 6—6 of FIG. 5;

FIG. 7 is a sectional view taken on the line 7—7 of FIG. 5;

FIG. 8 is a sectional view taken on the line 8—8 of FIG. 5;

FIG. 9 is an enlarged elevation showing a shaft provided on each piston rod;

FIG. 10 is a sectional elevation taken on the line 10—10 of FIG. 9;

FIG. 11 is an end elevation, partly in section, of the construction shown in FIG. 9;

FIG. 15 is an enlarged elevation showing a quarter of the head end of the cylinder block;

FIG. 16 is a sectional detail taken on the line 16—16 of FIG. 15 showing a seal at the head end of the cylinder block;

FIG. 17 is a sectional detail taken on the line 17—17 of FIG. 15 showing the junction between seals;

FIG. 18 is a sectional detail taken on the line 18—18 of FIG. 15;

DESCRIPTION OF THE PREFERRED EMBODIMENTS

Figure 1:
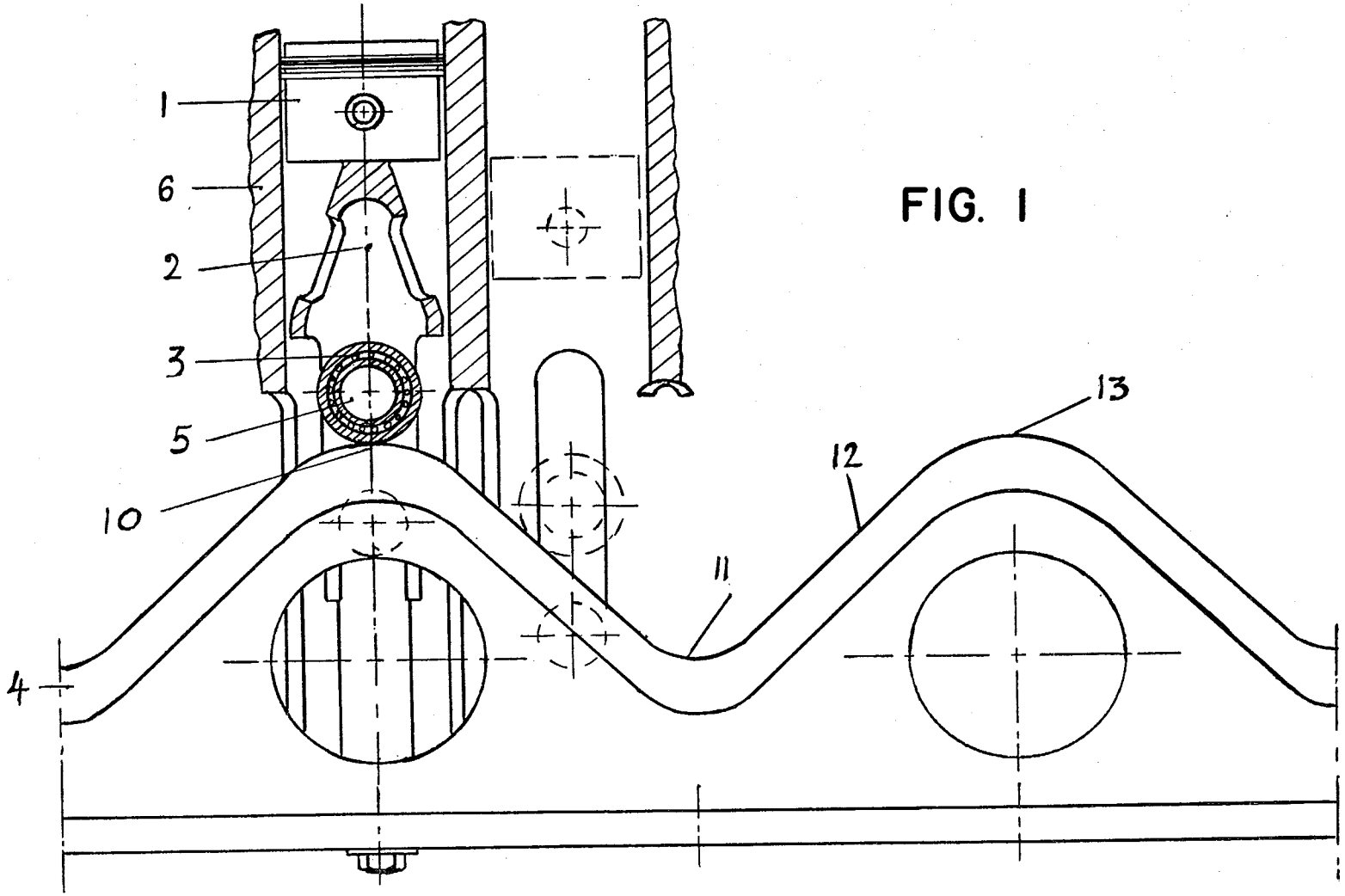
FIG. 1 is a schematic sectional elevation illustrating the relation between a cylinder and piston and a circular stationary rail of an engine constructed according to the present invention, the stationary rail being developed into planar rather than circular form for purpose of illustration.

As shown in FIG. 1, the principal components are: a piston 1; a rod 2 carrying on an axis 5 a bearing 3 which rolls on a guide rail 4 containing two "peaks" and two "valleys", all of the same size and shape; a cylinder block 6 (FIG. 4); a top cover or head 7 (FIG. 3) and a bottom cover 8 (FIG. 3) to which the guide rail 4 is attached.

The phase cycles are applied in the following manner, keeping in mind that the centers of the cylinders 9 lie on a circular plane, whose radius is the same as that of the circular plane on which the guide rail 4 is placed:

The cylinder block moves in a circular fashion relative to the track.

The intake begins as the piston commences its descent from a "peak" 10 (FIG. 1), and is completed as the piston reaches the bottom of the "valley" 11, which is the bottom dead center.

During the subsequent ascent 12, the intaken mixture is compressed up to the next "peak" 13, which is the top dead center. A spark is then produced by a spark plug, which ignites the mixture, therefore pushing the piston downward. The guide rail 4 thus guides the piston forwards together with the entire rotating block 6 which carries all of the other cylinders.

On the next ascent, the combusted gasses are released until the next "peak" is reached, and a new cycle begins again immediately afterwards.

Figure 2:
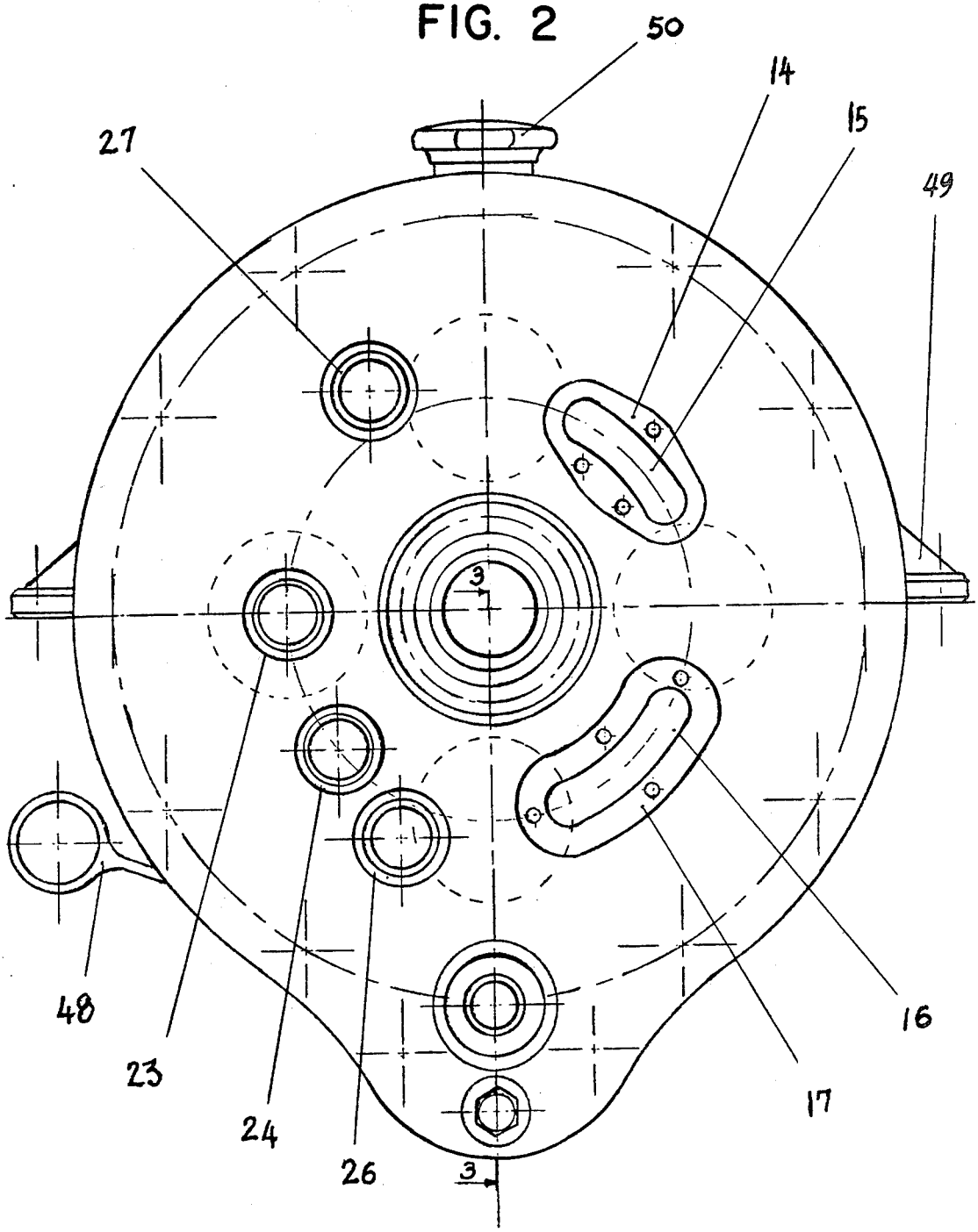
FIG. 2 is an elevation showing the head end of an engine constructed in accordance with the invention.

The intake of the mixture is prepared by a carburetor, whose intake port 14 can be seen in FIG. 2. The intake occurs by means of an opening 15 in the head-cover 7 which is always open on an arc of the circular surface, depending upon the distance of the intake descent of the piston. This process ends before the piston begins the next compression ascent, and begins immediately after the piston has completed the exhaust ascent.

In case deficiencies are found as far as the filling of the cylinders at high levels of rotation, an injection system with an injector and guillotine could be provided in order to adjust the opening corresponding to the various levels of rotation.

The discharge is brought about through an opening 16 (FIG. 2), analogous to the first phase of function, being permanently open always on a circular arc, which depends upon the arc of ascent on the exhaust of the piston. The exhaust receptor is directly attached to the exhaust port 17; the opening begins opening at bottom dead center, after ignition, and ends a little before the piston begins its intake descent at top dead center. In practice, all of the cylinders are fed upon the passing of a turn of the circular arc. The cylinders expel the gasses along another arc, which is the same for all the cylinders.

The compression is held in by the cylinder walls through the conventionally used rings 18 (FIG. 3), with the sealing of the head 7 made by a seal of the same material as that of the rings, lodged in a seat 19 on the upper edge of the cylinder, and pressed against the head 7 with an elastic element, a spring 20 of an appropriate rigidity and placed in the same seat.

The seals of each cylinder are matched with each other, adjacently, through two conjoining profiles 21 (FIG. 7), which permit an eventual variation in dimension, consequently resulting from the temperature of the engine. In order to favor the expansion, there is a lateral crack 22 at the point of minimal peripheral velocity.

The ignition is obtained through two spark plugs. One is placed in a socket 23 (FIG. 2) at top dead center at the end of the compression stroke, the other is placed at 24, immediately after the first, in order to complete the ignition of the mixture.

The spark plugs should obviously not project within the cylinder from the surface of the head in order not to interfere with the rotary motion of the cylinder block.

The cooling of the head 7 is brought about through the circulation of water into a hollow space 25 (FIG. 3) containing respective entry holes 26 and exit holes 27 (FIG. 2).

Figure 3:
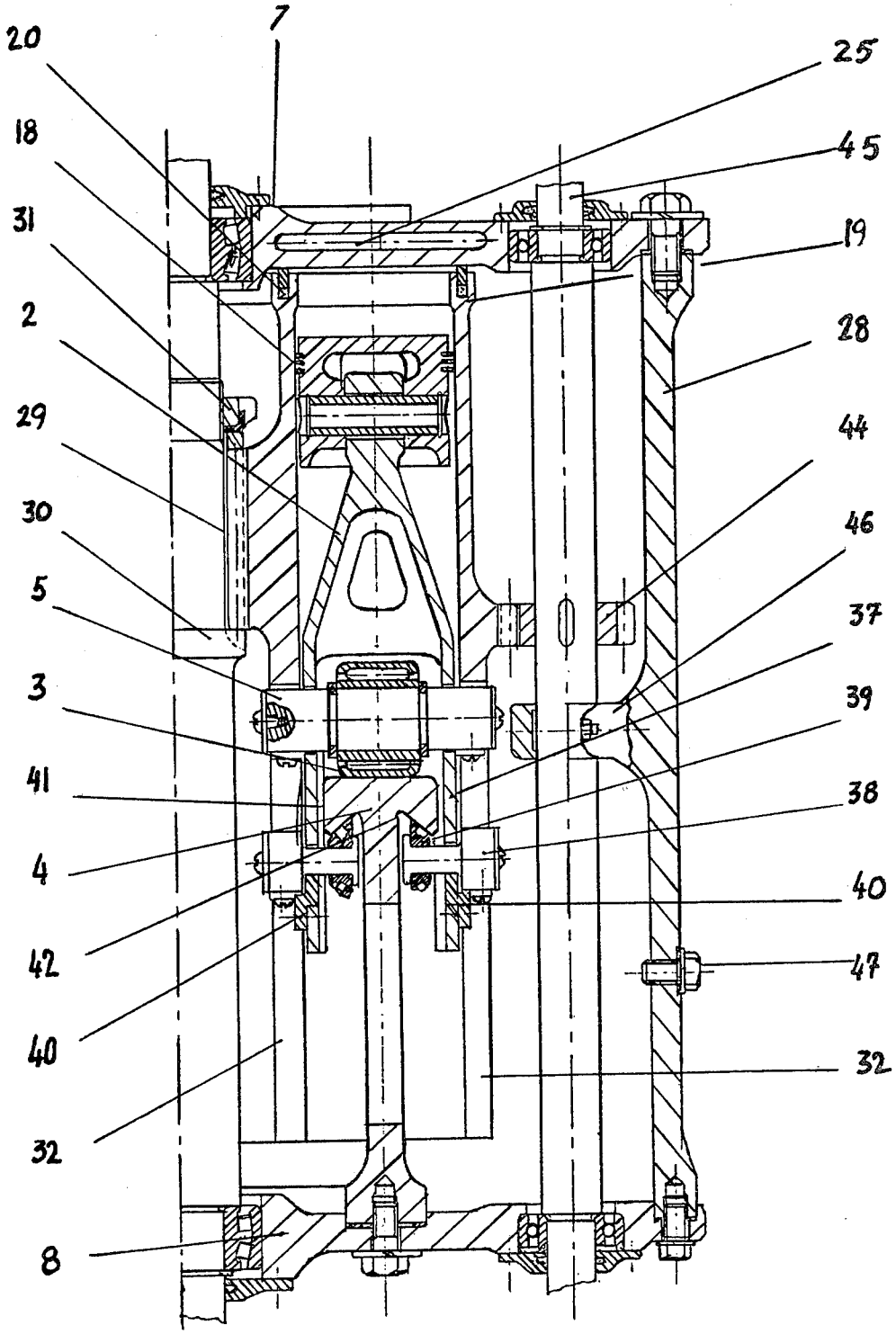
FIG. 3 is a sectional elevation taken as indicated by the line 3—3 of FIG. 2.

The lubrication of all the moving parts affected by rotation and friction is achieved through the use of oil, brought to the areas of friction through appropriately arranged holes by means of a traditional hydraulic circuit composed of pumps, filter, and a cooling radiator. The oil sump 28 is shown in FIG. 3.

The rotating block is connected to the motor shaft with a spline 29 (FIG. 3), and its fastening is achieved by means of a shoulder 30, and by layered lock-rings 31.

The shaft is supported on its ends by two bearings which permit slight inflections of the geometric axle. The bearings are fixed onto the head 7 and onto the lower cover 8.

The end of each cylinder of the block contains two conducting guides 32 (FIG. 3) mounted on opposite sides of the guide rail 4. On these conducting guides, the axle 5 of the main bearing 3 necessarily employs rollers 33 (FIG. 9) held in their races 34 by a retainer 35, which is fixed by means of screws.

The centering of the rod 2 is brought about a brace of stops 36 (FIG. 9) which are made of cover plates with screws; these are lodged in a recess, which permits adjustments. The screws are fixed into the axle. The rod 2 (FIG. 3) has a conic, bottle-neck shape, with two openings to allow lightness in weight, and ending with two "wings" 37, the internal "wing" being attached to the main shaft 5 in order to avoid its touching the guide rail 4 and to take the load off the inner bearing guide. These wings 37 extend on either side of the stationary guide rail 4 and within the rotary guides 32, and carry supports 38 engaging the guides 32 by a bearing system similar to that employed on the shaft 5, and conical bearings 39 engaging the lower guide surfaces 41 on the circular track 4.

In order to permit assembly, the extreme bottom 40 of the "wings" 37 is removable and attachable by means of screws.

The guide rail 4 (FIG. 3) containing a T-shaped section, is bolted and fixed to the bottom cover 8. Flanges 41 of the rail 4 form the seats of the conic bearings 39, whose thickness is similar to the depth of the recess 42. This section of the guide rail remains constant as measured along an axial line so that the piston rod-bearing system always remains axially parallel to the motor shaft.

On the axle 5 a bearing 3 made of cylindrical rollers of appropriate dimensions is fixed by means of elastic rings. This bearing rolls and glides on the adequately lubricated rail.

At the point of maximum diameter, the rotating block contains a ring gear 43 (FIG. 4) on which is engaged a spur gear 44 (FIG. 3) placed on a shaft 45 which is used to drive the accessories for water and oil circulation, the electrical system, and whatever other accessories might be demanded. This function is normally performed by the motor shaft.

The accessory drive shaft is rotatably supported by bearings in the two opposite end covers, and by one bearing 46 in the central part inside the sump, which includes a hole closed by a drain plug 47.

In order to control the oil level, an oil stick 48 (FIG. 2) is included, as well as an oil intake cap 50.

The motor is mounted in a horizontal position through two mounts 49 (FIG. 2) and by a support of the end of the motor shaft; its function and performance are normal, there not being any rotating or obstructing masses.

Figure 12:
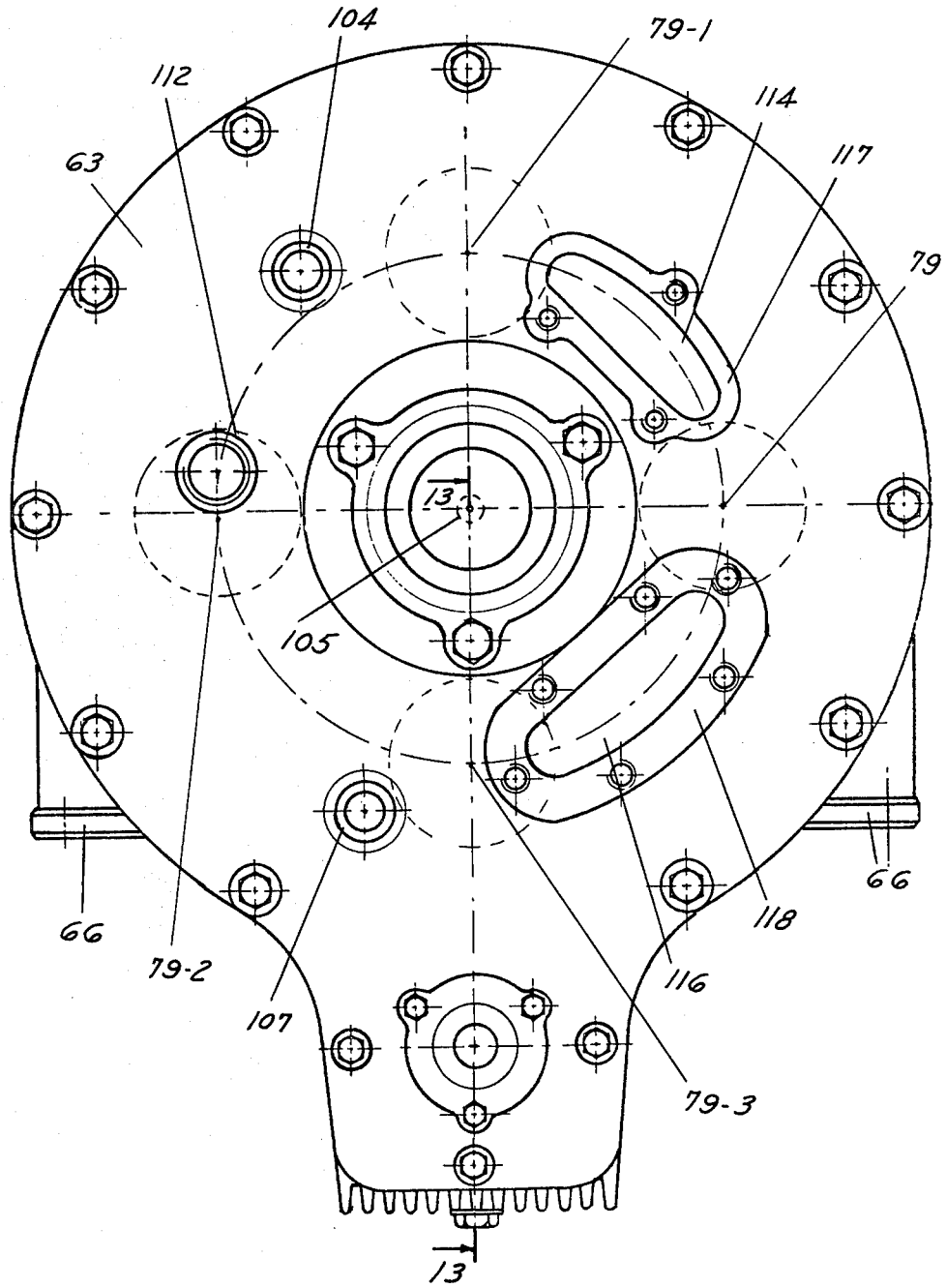
FIG. 12 is an elevation showing the head end of a second embodiment of the engine of the invention.
Figure 13:
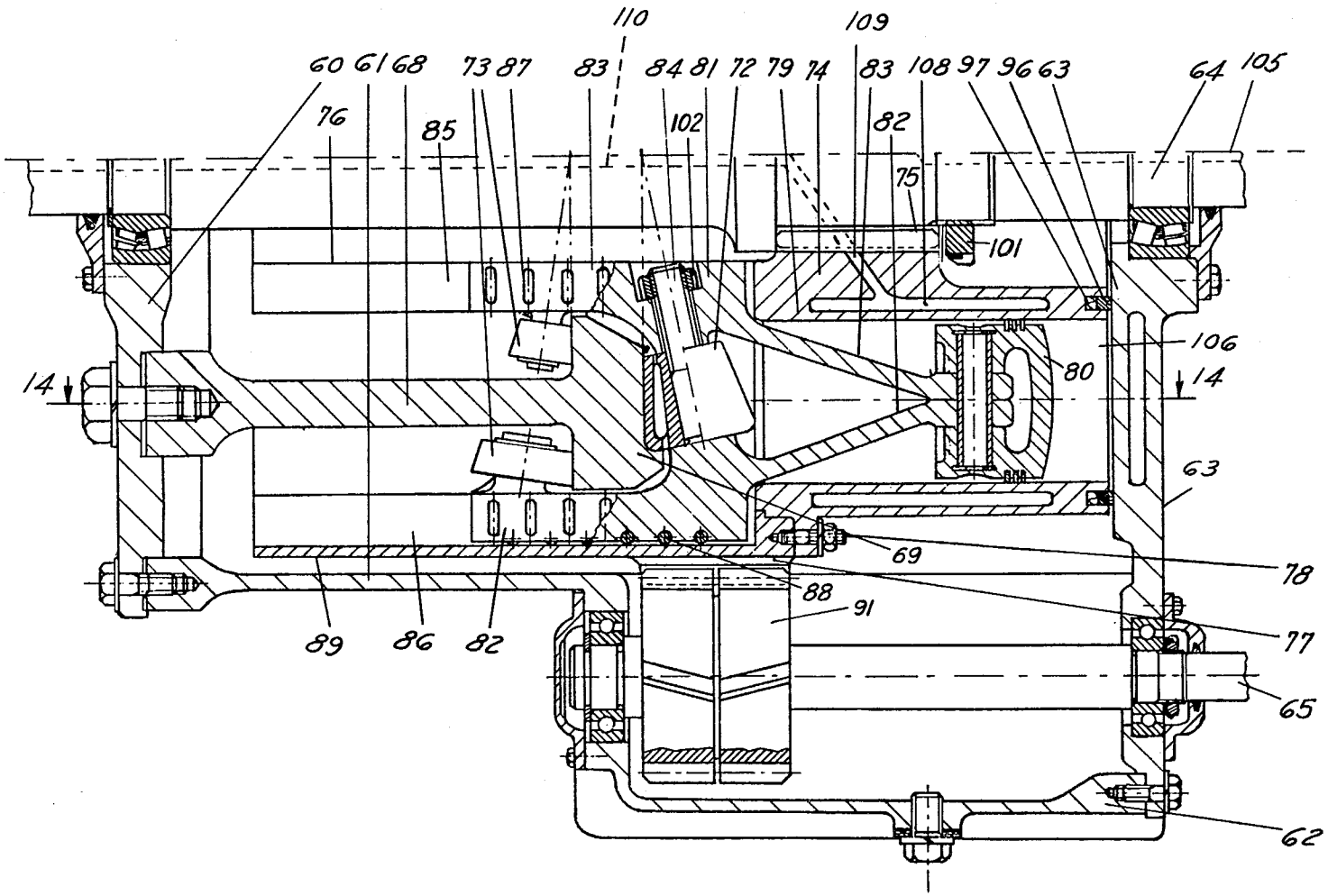
FIG. 13 is a longitudinal section taken as indicated by the line 13—13 of FIG. 12.

Turning now to the embodiment disclosed in FIGS. 12–20 and referring first to FIGS. 12 and 13, the engine consists of a housing formed by a rear cover 60, a cylindrical outer casing 61 having an offset sump portion 62, and a front cover or head 63. A main output shaft 64 is mounted in bearings carried by the head 63 and rear cover 60; and a secondary output shaft 65 is mounted in bearings carried by the offset sump portion 62 of the casing. Mounting pads 66, shown in FIG. 12, are formed as part of the casing 61 and serve to mount the engine on a suitable support.

Figure 14:
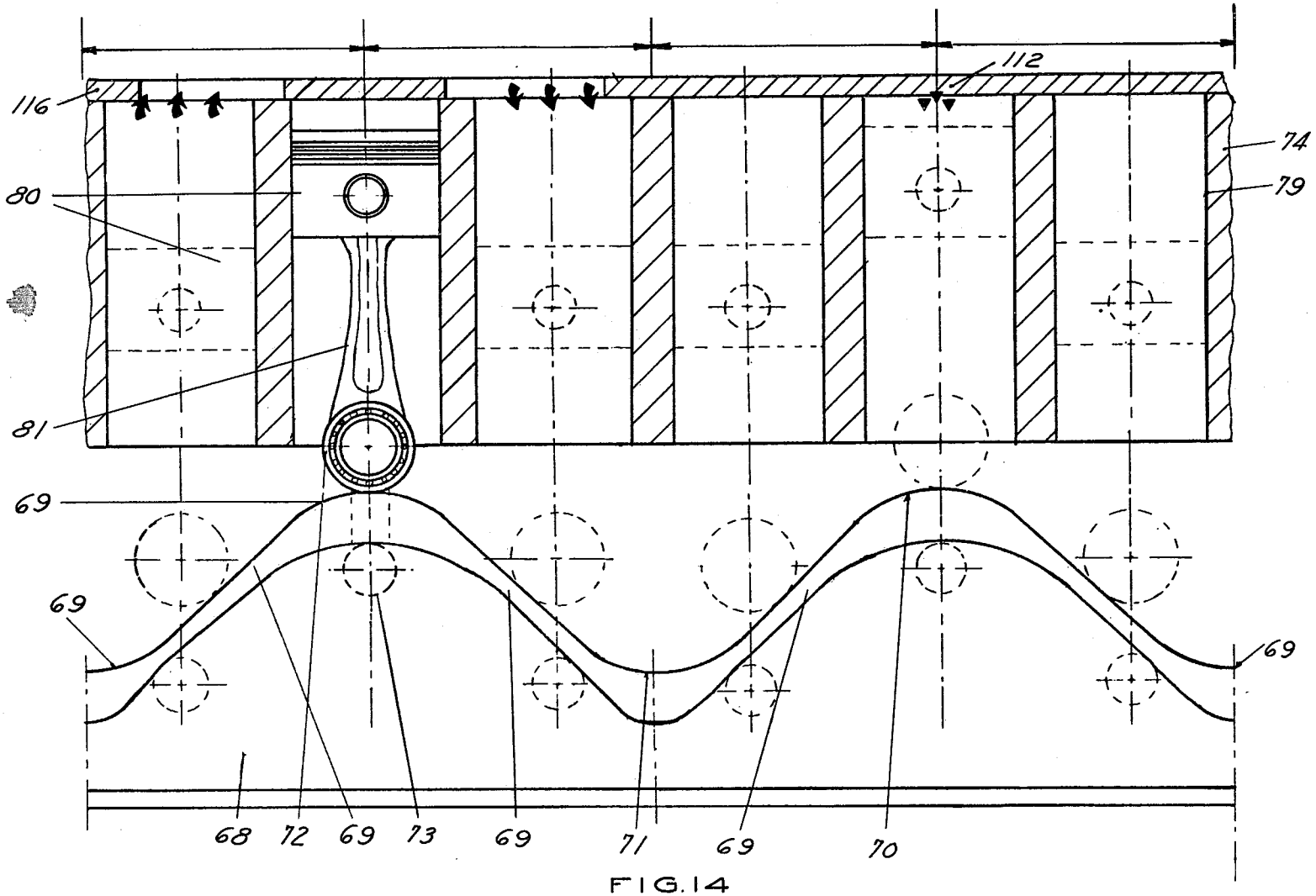
FIG. 14 is a developed sectional elevation taken as indicated by the line 14—14 of FIG. 13 showing the relation between the pistons and the track throughout 360° of rotation of the cylinder block.

A circular track or cam means 68 is bolted to the rear cover 60 and has a T-shaped end portion or drive rail 69 which extends in circumferential and radially spaced relation to the axis of the main shaft 64, and which is formed as a cam with peaks 70 and valleys 71, as shown in FIG. 14. The drive rail is engaged by a main roller follower 72 and by a pair of secondary roller followers 73 associated with each piston of a cylinder block assembly.

This cylinder block assembly includes an annular cylinder block 74 which is engaged with the main output shaft 64 by splines 75 (FIG. 15) and a lock ring 101 and rotates with the main shaft. The block 74 has an inner skirt 76, a removable outer skirt 77 connected by bolts 78, and the desired number of cylinders 79, there being six cylinders in the construction shown, all axially parallel to the main shaft 64. Mounted in each cylinder is a piston 80 connected to a rod assembly 81 having an outer portion 82 and an inner portion 83. The main roller follower 72 is carried by an axle 84 secured to the outer portion 82 and extending through an aperture in the inner portion, being secured thereto by a nut 102 as shown in FIG. 13. One of the secondary roller followers 73 is carried by the inner portion of the rod assembly, while the other of the secondary roller followers is carried by the outer portion. Each of the roller followers 72 and 73 is tapered, as shown in FIG. 13, and thier rotational axes are inclined relative to the surfaces of the guide rail which the roller followers engage so that projections of the roller follower axes and these guide rail surfaces intersect at the center of rotation of the cylinder block, or at the axis of the main shaft 64. Uniform rolling motion of the roller followers on their respective guide rail surfaces is then obtained.

Each rod assembly is mounted in a pair of inner and outer guide tracks formed in the cylinder block assembly. The inner one of these guide tracks is a slot 85 formed in the inner skirt 76 of the block and the outer one of these guide tracks is a groove 86 formed in the outer skirt. Rollers 87 carried by the inner portion 83 of the rod assembly engage the sides of the inner guide slot 85. Similar rollers carried by the outer portion 82 of the rod assembly engage the sides of the outer guide 86 and a third set of rollers 38 engage the bottom 89 of the outer guide.

A ring gear 90 on the outer circumference of the block drives a herringbone pinion 91 mounted on the secondary output shaft 65.

Figure 19:
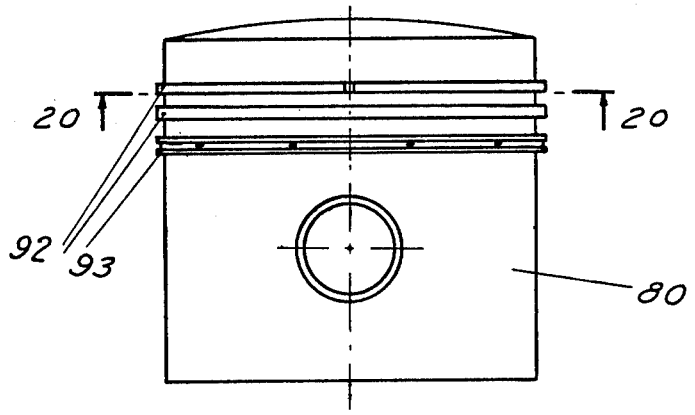
FIG. 19 is an elevation showing a piston and ring.
Figure 20:
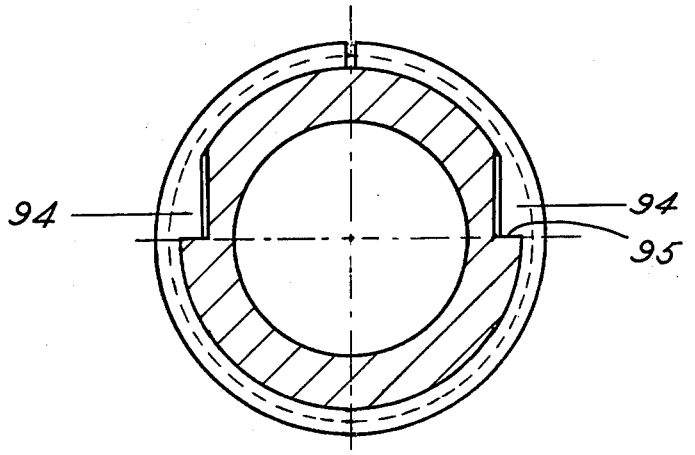
FIG. 20 is a sectional view taken as indicated by the line 20—20 of FIG. 19.

Each piston 80 is provided with a set of rings, as shown in FIG. 19, including a pair of compression rings 92 and an oil control ring 93. Each of these rings is seated in a groove provided with a pair of cut out portions 94, shown in FIG. 20, which have radially extending shoulders 95 facing toward the axis of rotation of the block and which are engaged by complimentary shaped portions on each of the rings. This arrangement provides uniform sealing action between the rings and the cylinder wall and compensates for centrifugal force acting on the piston and the rings.

Sealing between the block 74 and the head 63 is provided by a set of seals 96 shown in FIGS. 15–18, there being one seal 96 for each of the cylinders 79. Each seal 96 is seated in a recess in the end of the block 74, is urged into sealing contact with the head by a spring 97 positioned in the recess, and extends between a radial line on either side of one of the cylinders, as shown in FIG. 15. Adjacent seals 96 interlock by a projecting tang 98 on one seal engaging a recess 99 in the other seal as shown in FIG. 17 and the outer surface of each seal has concavities as indicated by the reference 100 in FIG. 18.

The cooling system includes a conventional radiator (not shown) from which coolant is supplied to the engine, entering through a port 104 (FIG. 12) in the head 63, and through a central passage 105 (FIG. 13) in the main shaft 64. These entry ports can be arranged in series or in parallel. Coolant entering the port 104 flows through passages 106 in the head and leaves through a port 107. Coolant entering the passage 105 flows to a jacket 108 in the block 74 through a radial passage (not shown) but corresponding to the radial return passage 109 (shown in FIG. 13) through which the coolant flows to a central outlet passage 110 in the shaft.

Ignition is by a conventional spark plug mounted in the socket 112 (FIG. 12) and operated by a conventional distributor type of system driven either from the main or secondary output shafts.

Lubrication is provided by a conventional oil pump and passages (not shown) as will be apparent to those skilled in the art.

As in the case of the first embodiment of this invention shown in FIGS. 1–11, valving of the intake and exhaust functions occurs in response to rotation of the block 74 relative to the head 63. Rotation of the block 74 through an arc corresponding approximately to the intake stroke of one of the pistons 80 takes place during the time the cylinder of that piston is in communication with an intake port 114 in the head 63; and correspondingly, the exhaust stroke of one of the pistons 80 takes place during the time the cylinder of that piston is in communication with an exhaust port 116 in the head 63. These intake and exhaust ports appear in FIG. 12 and their relation to the cylinders of the rotating block 63 are shown in FIG. 14. A carburetor (not shown) is attached to the flange 117 (FIG. 12) surrounding the intake port 114, while an exhaust pipe (not shown) is attached to the flange 118 surrounding the exhaust port 116. In FIG. 12, the cylinders 79 are indicated schematically in four different positions—cylinder 79-1 at the beginning of the compression stroke, cylinder 79-2 at the beginning of the working stroke, cylinder 79-3 at the beginning of the exhaust stroke, and cylinder 79-4 at the beginning of the intake stroke of the respective pistons in each of these cylinders.

Engines of the type disclosed in the embodiments of the invention described above offer certain advantages, among which are:

1. since reciprocating movements of the piston takes place on a line parallel to the axis of rotation of the main output shaft as well as to the axis of rotation of the cylinder block, the piston is not acting against centrifugal force resulting from the rotational output of the engine;

2. the arrangement of cylinders on axes parallel to the axis of cylinder block rotation results in a very compact engine for a given total displacement;

3. the compactness, mentioned in advantage 2 above, is enhanced by the fact that the valving of the cylinders does not require the valves, camshaft and associated parts found in a conventional engine using a crankshaft;

4. the automatic valving of the cylinders accomplished simply by rotation of the cylinder block relative to valve parts in the cylinder head results in an appreciable saving in weight;

5. for an engine of given stroke the guide rail configuration can be essentially standardized, regardless of the number of cylinders used since but two peaks and two valleys are required in 360° of guide rail for a four-cycle engine, regardless of the number of cylinders.

6. As the number of cylinders is increased, the number of such cylinders acting simultaneously on a power stroke on the guide rail is increased.

The embodiment disclosed in FIGS. 12–20 is presently preferred due to the positive guiding of the piston rod in combination with anti-friction rollers for resisting and counteracting centrifugal force on the piston rod; also due to the improved coaction between the piston rod and guide rail obtained from the conical roller followers and the arrangement of their axes of rotation relative to the axis of rotation of the cylinder block; and further due to the sealing means between the rotating cylinder block and head which acts individually for each cylinder but with compensation for each adjacent cylinder and for operating temperature.

While a four-cycle internal combustion engine has been disclosed and described, it is apparent that the same basic construction can be employed as a fluid pressure engine and operated by steam, compressed air or hydraulic fluid on two power strokes per revolution by merely providing an additional exhaust port and an intake port in the cylinder head, appropriately placed and designed for the kind of pressurized fluid used to drive the pistons on their working strokes.

Other features and advantages of the invention will be apparent to those skilled in the art.

I claim:

1. In a rotary internal combustion engine having an output shaft, a cylinder block including at least one cylinder, a housing in which the output shaft and the cylinder block are rotatably mounted with the axis of the cylinder extending parallel to and spaced radially from the axis of rotation of the cylinder block, means for drivingly connecting the cylinder block to the output shaft, a piston reciprocably mounted in the cylinder, a rod connected to the piston, cam means engageable by the rod for defining reciprocating movements of the piston and converting said movements into rotary motion of the cylinder block, said cam means comprising an annular cam member carried by the housing in concentric relation to the axis of rotation of the cylinder block and having axially opposed cam surfaces formed on a T-shaped free end in symmetrical relation with respect to the circular plane defined by rotation of the cylinder axis about the axis of rotation of the cylinder block, and guide means on the cylinder block for defining movement of the piston rod relative to the cam means, the improvement wherein:

the piston rod is provided with radially inner and outer separate portions straddling said free end of the cam member;

the cylinder block includes radially inner and outer skirts respectively positioned adjacent to said inner and outer portions of the piston rod, said guide means comprising radially inner and outer guide tracks formed in said inner and outer skirts, respectively, said guide tracks each having a pair of surfaces spaced circumferentially of the cylinder axis and adapted to define a path of movement parallel to the cylinder axis for the inner and outer portions of the piston rod, said outer guide track including a guide surface facing the cylinder axis and extending parallel thereto;

anti-friction roller means are carried by said inner and outer portions of the piston rod for engaging said guide track surfaces and maintaining said piston rod portions in axially and radially defined relation to said cam means;

a drive roller is mounted on an axle carried by said inner and outer piston rod portions and engageable with a drive cam surface on said cam means and facing the cylinder; and radially inner and outer retaining rollers are carried by axles on said inner and outer rod portions, respectively, each of said retaining rollers being engageable with one of a pair of retaining cam surfaces on said cam means and facing oppositely from the cylinder.

2. A rotary internal combustion engine according to claim 1 wherein said cam surfaces are normal to the axis of rotation of the cylinder block, and said drive roller is a tapered roller whose axis intersects a projection of said drive cam surface at said axis of rotation.

3. A rotary internal combustion engine according to claim 2 wherein said retaining rollers are tapered rollers mounted on a common axis which intersects a projection of said retaining cam surfaces at said axis of rotation.

4. A rotary internal combustion engine according to claims 1 or 3 wherein said radially inner and outer separate rod portions are pivotally connected to the piston on an axis extending radially to the axis of rotation of the cylinder block.

5. A rotary internal combustion engine according to claim 1 wherein said anti-friction roller means comprises a plurality of axially spaced rollers engaging each of said guide track surfaces.

6. A rotary internal combustion engine according to claim 1 wherein said drive cam surface includes a portion extending normal to the axis of rotation of the cylinder block and engaged by said drive roller, and a portion extending generally parallel to said axis of rotation and engagable by to the radially outer end of said drive roller.

7. A rotary internal combustion engine according to claim 1 wherein coolant passages are formed in said cylinder block, a coolant inlet passage extending axially in said output shaft from one end thereof, a coolant outlet passage extending axially in said output shaft from the other end thereof, and radially extending passage means in said output shaft and cylinder block for connecting the coolant passages therein with said cooling inlet and outlet passages.

8. A rotary internal combustion engine according to claim 7 wherein said radially extending passage means extend through said means for drivingly connecting the cylinder block to the output shaft.

9. A rotary internal combustion engine according to claim 1 wherein the housing includes a cylinder head opposed to one end of the cylinder block, seal means are interposed between the cylinder head and cylinder block, said seal means comprising a recess formed in the end of the cylinder block opposed to the cylinder head, said recess extending around the cylinder and including laterally projecting portions on either side of the cylinder, each of said laterally projecting recess portions extending to a line radial to the axis of rotation of the cylinder block; and a seal is seated in said recess, the seal having lateral portions fitted in said laterally projecting recess portions, and interlock means on said lateral seal portions extending along said radial line.

10. A rotary internal combustion engine according to claim 9 wherein the outer surface of the seal opposed to the cylinder head is provided with a cavity.

11. A rotary internal combustion engine according to claim 1 wherein said piston is provided with grooves, a set of rings mounted in said grooves, each groove having a pair of radially extending shoulders facing toward the axis of rotation of the cylinder block, and each ring having complimentary shaped portions engaging said shoulders.

12. A rotary internal combustion engine according to claim 9 wherein said laterally projecting recess portions each include a groove in the cylinder block extending parallel to said radial line, and said lateral portions of the seal are each provided with a projection engaging said groove.

13. A rotary internal combustion engine according to claim 12 further including spring means mounted in each groove and engaging said projection provided on the seal.

14. A rotary internal combustion engine according to claim 13 wherein said spring means spaces at least a part of the seal from the bottom of the recess.

15. A rotary internal combustion engine according to claim 14 wherein said part of the seal includes said lateral portion thereof.

16. In a rotary internal combustion engine having an output shaft, a cylinder block including at least one cylinder, a housing in which the output shaft and the cylinder block are rotatably mounted with the axis of the cylinder extending parallel to and spaced radially from the axis of rotation of the cylinder block, means for drivingly connecting the cylinder block to the output shaft, a piston reciprocably mounted in the cylinder, a rod connected to the piston, cam means engageable by the rod for defining reciprocating movements of the piston and converting said movements into rotary motion of the cylinder block, said cam means comprising an annular cam member carried by the housing in concentric relation to the axis of rotation of the cylinder block and having axially opposed cam surfaces formed on a T-shaped free end in symmetrical relation with respect to the circular plane defined by rotation of the cylinder axis about the axis of rotation of the cylinder block, and guide means on the cylinder block for defining movement of the piston rod relative to the cam means, the improvement wherein:

the housing includes a cylinder head opposed to one end of the cylinder block;

seal means are interposed between the cylinder head and cylinder block, said seal means comprising a recess formed in the end of the cylinder block opposed to the cylinder head, said recess extending around the cylinder and including laterally and oppositely projecting portions each extending to a line radial to the axis of rotation of the cylinder block; and, a seal is seated in said recess, the seal being provided with lateral portions fitted in said laterally projecting recess portions and with interlock means on said lateral seal portions extending along said radial line.

17. In a rotary internal combustion engine having an output shaft, a cylinder block including at least one cylinder, a housing in which the output shaft and the cylinder block are rotatably mounted with the axis of the cylinder extending parallel to and spaced radially from the axis of rotational of the cylinder block, means for drivingly connecting the cylinder block to the output shaft, a piston reciprocably mounted in the cylinder, a rod connected to the piston, cam means engageable by the rod for defining reciprocating movements of the piston and converting said movements into rotary motion of the cylinder block, said cam means comprising an annular cam member carried by the housing in concentric relation to the axis of rotation of the cylinder block and having axially opposed cam surfaces formed on a T-shaped free end in symmetrical relation with respect to the circular plane defined by rotation of the cylinder axis about the axis of rotation of the cylinder block, and guide means on the cylinder block for defining movement of the piston rod relative to the cam means, the improvement wherein:

the piston rod is provided with radially inner and outer separate portions straddling said free end of the cam member;

a drive roller is mounted on an axle connected to said inner and outer piston rod portions and is engageable with a drive cam surface on said cam means and facing the cylinder;

radially inner and outer retaining means are carried respectively by said inner and outer piston rod portions and are engageable respectively with radially inner and outer retaining cam surfaces on said cam means and facing oppositely from the cylinder;

the cylinder block includes radially inner and outer skirts respectively positioned adjacent to said inner and outer portions of the piston rod, said guide means comprising radially inner and outer guide tracks formed in said inner and outer skirts, respectively, said guide tracks each having a pair of parallel surfaces adapted to define the path of movement of said inner and outer piston rod portions, said outer guide track including a guide surface facing the axis of rotation of the cylinder block; and means on said inner and outer piston rod portions for engaging said guide track surfaces at axially spaced locations adjacent to said drive roller and retaining means.

* * * * *

UNITED STATES PATENT AND TRADEMARK OFFICE

CERTIFICATE OF CORRECTION

PATENT NO. : 4,213,427

DATED : July 22, 1980

INVENTOR(S) : ALFONSO DI STEFANO

It is certified that error appears in the above—identified patent and that said Letters Patent is hereby corrected as shown below:

Column 4, line 7, after "about" insert -- by --.

Column 10, line 11, "rotational" should read -- rotation --.

Signed and Sealed this

*Fourth* Day of *November 1980*

[SEAL]

*Attest:*

SIDNEY A. DIAMOND

*Attesting Officer*

*Commissioner of Patents and Trademarks*